US008596961B2

(12) United States Patent
Tibbott et al.

(10) Patent No.: US 8,596,961 B2
(45) Date of Patent: Dec. 3, 2013

(54) AEROFOIL AND METHOD FOR MAKING AN AEROFOIL

(75) Inventors: Ian Tibbott, Lichfield (GB); Ian W R Harrogate, Uttoxeter (GB)

(73) Assignee: Rolls-Royce PLC, London (GB)

( * ) Notice: Subject to any disclaimer, the term of this patent is extended or adjusted under 35 U.S.C. 154(b) by 1084 days.

(21) Appl. No.: 12/458,905

(22) Filed: Jul. 27, 2009

(65) Prior Publication Data

US 2010/0124484 A1 May 20, 2010

(30) Foreign Application Priority Data

Jul. 30, 2008 (GB) ..... 0813839.8

(51) Int. Cl.
*F01D 5/18* (2006.01)

(52) U.S. Cl.
USPC ..... 415/115; 416/96 A

(58) Field of Classification Search
USPC ..... 415/115; 416/95, 96 A, 96 R, 97 R
See application file for complete search history.

(56) References Cited

U.S. PATENT DOCUMENTS

| | | | | |
|---|---|---|---|---|
| 3,370,829 | A | 2/1968 | Banthin et al. | |
| 4,786,233 | A * | 11/1988 | Shizuya et al. | 416/97 R |
| 5,704,763 | A * | 1/1998 | Lee | 416/96 R |
| 7,104,756 | B2 * | 9/2006 | Harding et al. | 416/96 A |
| 7,179,047 | B2 * | 2/2007 | Cooper | 415/115 |
| 2010/0124485 | A1 * | 5/2010 | Tibbott | 415/115 |
| 2010/0254801 | A1 * | 10/2010 | Tibbott | 415/115 |

FOREIGN PATENT DOCUMENTS

| | | | |
|---|---|---|---|
| CA | 967095 | | 5/1975 |
| EP | 0 990 771 | A1 | 4/2000 |
| EP | 1 002 615 | A2 | 5/2000 |
| EP | 1 088 964 | A2 | 4/2001 |
| EP | 1 156 187 | A2 | 11/2001 |
| EP | 1 156 187 | A3 | 7/2003 |
| EP | 1 626 162 | A1 | 2/2006 |
| GB | 2 189 553 | A | 10/1987 |
| GB | 2 335 239 | A | 9/1999 |
| GB | 2 335 240 | A | 9/1999 |
| GB | 2 405 451 | A | 3/2005 |
| WO | WO 99/61768 | | 12/1999 |

OTHER PUBLICATIONS

European Search Report dated Nov. 20, 2009.

* cited by examiner

*Primary Examiner* — Nathaniel Wiehe
*Assistant Examiner* — Ryan Ellis
(74) *Attorney, Agent, or Firm* — Oliff & Berridge, PLC

(57) ABSTRACT

Within aerofoils, and in particular nozzle guide vane aerofoils in gas turbine engines problems can occur with regard to coolant flows from respective inlets at opposite ends of a cavity within the aerofoil. The cavity generally defines a hollow core and unless care is taken coolant flow can pass directly across the internal cavity. Previously baffle plates were inserted within the cavity to prevent such direct jetting across the cavity. Such baffle plates are subject to additional costs as well as potential unreliability problems. Baffles formed integrally with a wall within the aerofoil allow more reliability with regard to positioning as well as consistency of performance. The baffles can be perpendicular, upward or downwardly orientated or have a compound angle.

13 Claims, 5 Drawing Sheets

1
2
3
4
5
6
7
8
9
10
11
12
13
14
A
A
B
C

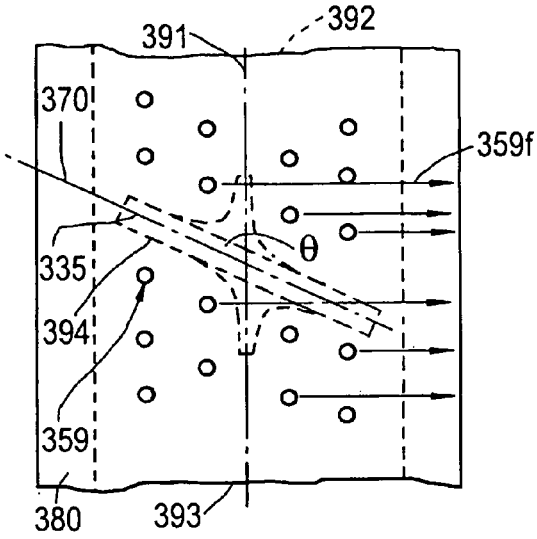
Fig.8
Fig.9 (a)
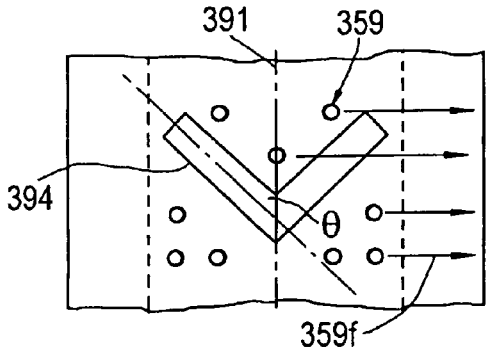
Fig.9 (b)
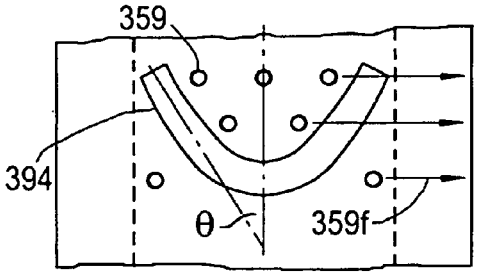
Fig.9 (c)
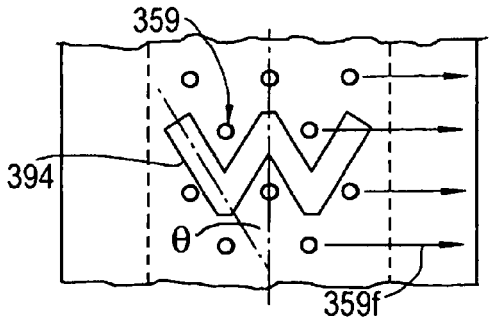

AEROFOIL AND METHOD FOR MAKING AN AEROFOIL

The present invention relates to aerofoils and more particularly to nozzle guide vanes utilised in gas turbine engines.

Within a gas turbine engine it will be appreciated that the performance of the gas turbine engine cycle, whether made in terms of efficiency or specific output, is improved by increasing the turbine gas temperature. In such circumstances it is desirable to operate the turbine at as high a gas temperature as possible. For any engine cycle, in terms of compression ratio or bypass ratio, increasing the turbine entry gas temperature will always produce more specific thrust. Unfortunately, as turbine engine temperature increases it will be understood that the life of an uncooled turbine blade falls necessitating the development of better materials and/or internal cooling of the blades.

Modern gas turbine engines operate at turbine gas temperatures which are significantly hotter than the melting point of the blade material used. Thus, at least high pressure turbines as well as possibly intermediate pressure turbines and low pressure turbines are cooled. During passage through the turbine it will be understood that the temperature of the gas decreases as power is extracted. In such circumstances the need to cool static or rotating parts of the engine decreases as the gas moves from the high temperature stages to the low temperature stages through to the exit nozzle for the engine.

Typical forms of cooling include internal convection and external films. A high pressure turbine nozzle guide vane (NGV) consumes the greatest amount of cooling air. High pressure turbine blades typically use approximately half of the coolant that is required for nozzle guide vanes. Intermediate and low pressure stages down stream of the high pressure turbine progressively utilise and need less cooling air.

The coolant used is high pressure air taken from a compressor. The coolant bypasses the combustor and is therefore relatively cool compared to the gas temperature of the working fluid. The coolant temperature often will be 700 to 1000K whilst working gas temperatures will be in the excess of 2000K.

By taking cooling air from the compressor it will be understood that the extracted compressed air can not be utilised to produce work at the turbine. Extracting coolant flow from the compressor has an adverse effect upon engine overall operating efficiency. In such circumstances it is essential that coolant air is used most effectively.

FIG. 1 provides a pictorial illustration of a typical prior blade arrangement including a nozzle guide vane (NGV) and a rotor blade 2. A nozzle guide vane 1 comprises an outer platform 3, an inner platform 4 and an aerofoil vane 5 between. A rotor blade 2 comprises a shroud 6, a platform 7 with an aerofoil blade 8 between them. The guide vane 1 is substantially static and fixed whilst the rotor blade 2 rotates upon a rotor disc 9 secured through a blade root 10. Generally, a seal shroud 11 is provided in association with a support casing 12 in order to define a path across the arrangement 13 in the direction of arrowheads A. The vanes 1 and rotor blades 2 will generally be in assembly as indicated with the vanes stable and static whilst the rotor blades 2 rotate in the direction of arrowheads B to generate flow.

In such circumstances generally coolant for respective vanes and blades 5, 8 is through a combination of dedicated cooling air and secondary leakage flow especially from aerofoil components such as platforms and shrouds. Nozzle guide vane platforms 3, 4 and blade platforms 7 generally use leakage flow to cool an upstream region. Dedicated coolant flow is used to cool down regions of the platforms 3, 4, 7.

Generally, high pressure turbine nozzle guide vanes are formed as aerofoils with cooling air bled from cavities above an outer platform and from below an inner platform. The coolant flows to cool a leading edge of the aerofoils. As the feed pressure of the cooling air is available only marginally above the hot gas flow pressure at the stagnation point at the aerofoil leading edges, an inlet for coolant at both ends of the aerofoil is required. It will be understood that a single feed system will need an increase in the velocity of the coolant at entry to the aerofoil causing unacceptably high entry losses and associated pressure drop.

Unfortunately, feed pressures in the cavities formed within aerofoils to define nozzle guide vanes are not stable at the respective inlets at either end of the cavity. In such circumstances, it is necessary to partially block the coolant flow from passing directly through the aerofoil cavity from outboard to inboard or vice versa. It will be understood that if such direct flow were allowed to happen not only would entry losses become unacceptable but static pressure in the cavity itself, which drives film cooling would also fall below the required level to ensure hot gas ingestion does not occur.

One practical way of preventing cooling air jetting directly through the cavity in either direction is to introduce a sheet metal baffle or plate mounted on a backing plate which is secured to the inside of the cavity by a series of tangs. The position of the baffle plate within the cooling passage cavity can easily be controlled by changing the length of the backing plate. The ideal location of the baffle plate is where the feed pressure and losses are balanced to give the same minimum pressure margin between the internal coolant pressure and the hot gas flow at both aerofoil root and tip locations. Unfortunately it is also advisable to avoid peaks in hot gas profile if at all possible.

Examples of typical prior approaches to providing sheet metal baffles relate to fitting the baffle plate within a forward cooling cavity of a nozzle guide vane. The baffle plate is inserted through an outer platform leading edge cavity and utilises locating lugs to position the baffle plate and lock the baffle plate in place by bending over tabs or tangs which extend through apertures in a wall located at the outer end of the backing plates. The baffle plates are attached to the backing plates by a weld joint. To prevent flapping in use the baffle plate is generally supported and presented upon a strengthening web. Coolant air is then allowed to enter the cavity from either end through appropriate inlets with the baffle plate then preventing direct jetting therethrough. A further alternative is to utilise a perforated metal tube again presented within the cavity formed within the aerofoil. A baffle plate is incorporated into the impingement tube to prevent cooling air from passing directly through the tube from inlets either side of the cavity.

In view of the above, prior arrangements are typically relatively fragile but also expensive to manufacture and fit. These baffle plates with backing plates are subject to vibration, fracture and the baffle itself may become detached from the backing plate resulting in aerofoils which do not operate correctly and therefore overheat and may oxidise prematurely.

Thus prior arrangements for providing baffles within aerofoils such as nozzle guide vanes have typically been expensive to manufacture and fit. Furthermore, by provision of separate baffle plates there is an increase in component count which can tend to provide unreliability in terms of remaining in place during the whole aerofoil's life with potential problems including vibration failure, relative movement between the mating parts due to wear. The arrangement is not failsafe in that it is possible there is incorrect location or failure to fit at all. Furthermore it will be appreciated that consistent positioning of the baffle is difficult in view of the potential for up-down slide movement of the baffle plate in use. It will also be understood that the baffle plate may be damaged or malformed during assembly procedures. Furthermore, where an aerofoil incorporates more than one cavity it is possible that incorrect baffle plates may be assembled in the wrong cavity resulting in inappropriate operation. Finally, as gas and coolant temperatures increase in an engine the sheet metal baffle plate material will become weaker and therefore less resistant to oxidation attack and degradation of the material from which the aerofoil is formed.

In accordance with aspects of the present invention there is provided an aerofoil having a hollow core to define a cavity with an inlet for fluid flow in use at respective opposite ends, the core having a wall, the aerofoil characterised in that a baffle is integrally formed with the wall to extend across the cavity to present a flow restraint between the inlets at the respective opposite ends.

Typically, the respective opposite ends are inner and outer parts of the aerofoil.

Generally, the wall is a divider wall within the cavity. Alternatively, the wall is an external wall or any wall extending between the respective opposite ends.

Generally, apertures are provided in a surface opposite the wall.

Possibly, the baffle is substantially perpendicular to the wall and extends towards the apertures. Alternatively, the baffle is at an angle between 30° and 60° to a perpendicular projected from the wall towards the apertures. Possibly, the baffle is presented at an angle laterally inclined from one side to the other in a direction between the respective opposed ends.

Possibly, the apertures are angled.

Possibly, the baffle is orientated towards alignment with the apertures.

Possibly, the baffle is substantially flat. Alternatively, the baffle is curved. Possibly, the baffle is curved to provide a half cylindrical cross section. Alternatively, the baffle is curved to provide a scoop shaped projection from the wall.

Typically, the baffle extends nearly fully across the cavity to define a predetermined available cross sectional area for fluid flow exchange either side of the baffle.

Typically, the cavity incorporates a plurality of baffles. Possibly the baffles are positioned to present an indirect path between the inlets at each respective opposed end. Possibly the cavity has a principal baffle to substantially divide the cavity and a respective partial baffle at a relatively spaced location laterally from an inlet to define variations in the cross sectional area of the cavity across which a fluid flow in use can flow from an inlet at one of the opposed respective ends of the aerofoil.

Possibly, the baffle has a web extending to stiffen association of the baffle with the wall. Possibly, the web comprises a fillet element extending laterally from the baffle along the wall.

Possibly, the baffle is perforated with holes. Possibly the holes are orientated relative to the apertures.

Also in accordance with aspects of the present invention there is provided a method of forming an aerofoil comprising defining a hollow core between inlets at respective opposed ends of the aerofoil, the method characterised in that the aerofoil is cast with a baffle extending from a wall intermediate the inlets towards an opposed surface.

Generally, the method also incorporates forming apertures by drilling or cutting or finishing pre-cast apertures by a process tool orientated relative to the baffle. Possibly, the method includes ensuring that the process tool can only be presented at an orientation angle to ensure the process tool cannot clash with the baffle.

Embodiments and aspects of the present invention will now be described by way of example and with reference to the accompanying drawings in which.

Figure 6:
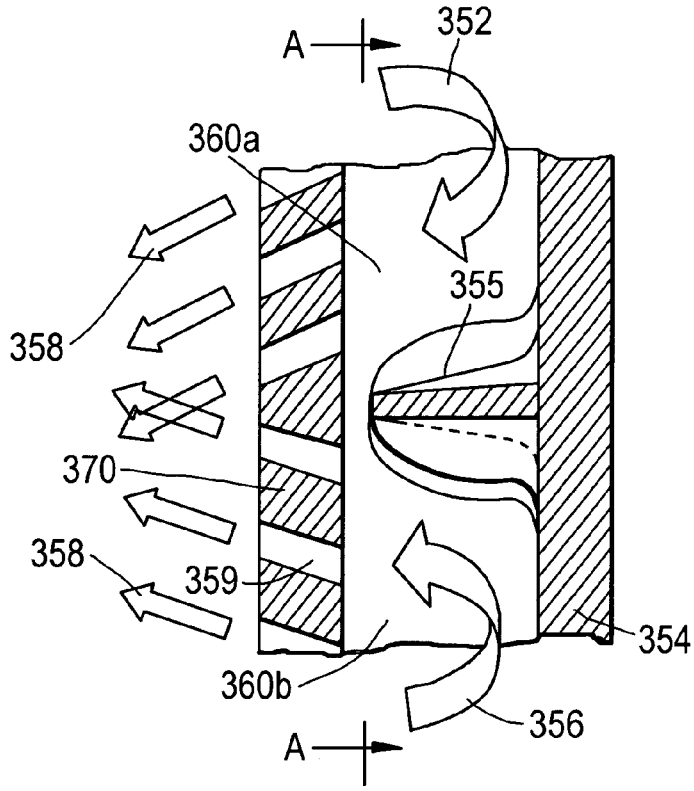
Figure 7:
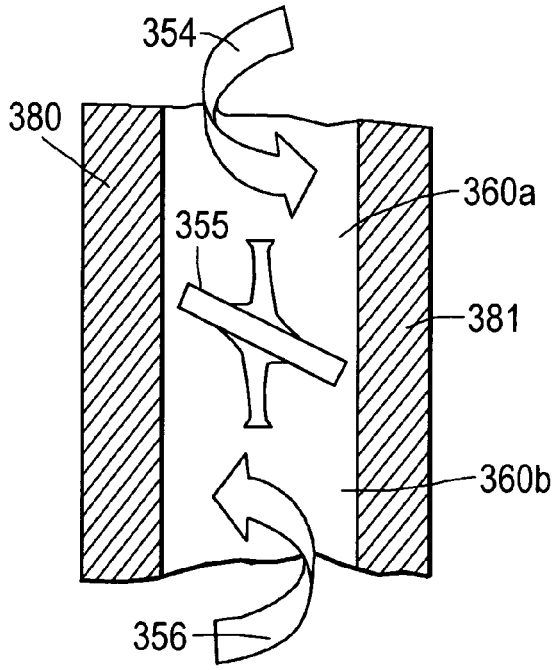

FIG. 6 provides a side schematic view of a third configuration of a baffle in accordance with aspects of the present invention; and, FIG. 7 is a side view in the direction of A-A of the baffle depicted in FIG. 6.

FIG. 8 is an axial rearward view on part of a leading edge of an aerofoil in accordance with the present invention;

FIGS. 9*a, b, c* are axially rearward views on different arrangements of the baffle and are in accordance with the present invention.

Aspects of the present invention eliminate the need for a separate baffle plate. Such elimination is achieved through casting a baffle within a wall as part of the manufacturing process for the aerofoil. It will be appreciated that the aerofoil will incorporate apertures to allow development of a cooling film upon the aerofoil surfaces. These apertures may be cast into the aerofoil during a normal manufacturing process or formed by drilling post initial casting of the aerofoil. In any event aspects of the present invention ensure that the forming process for the apertures is arranged such that the baffle plate is not fouled or destroyed by this process.

Figure 1:
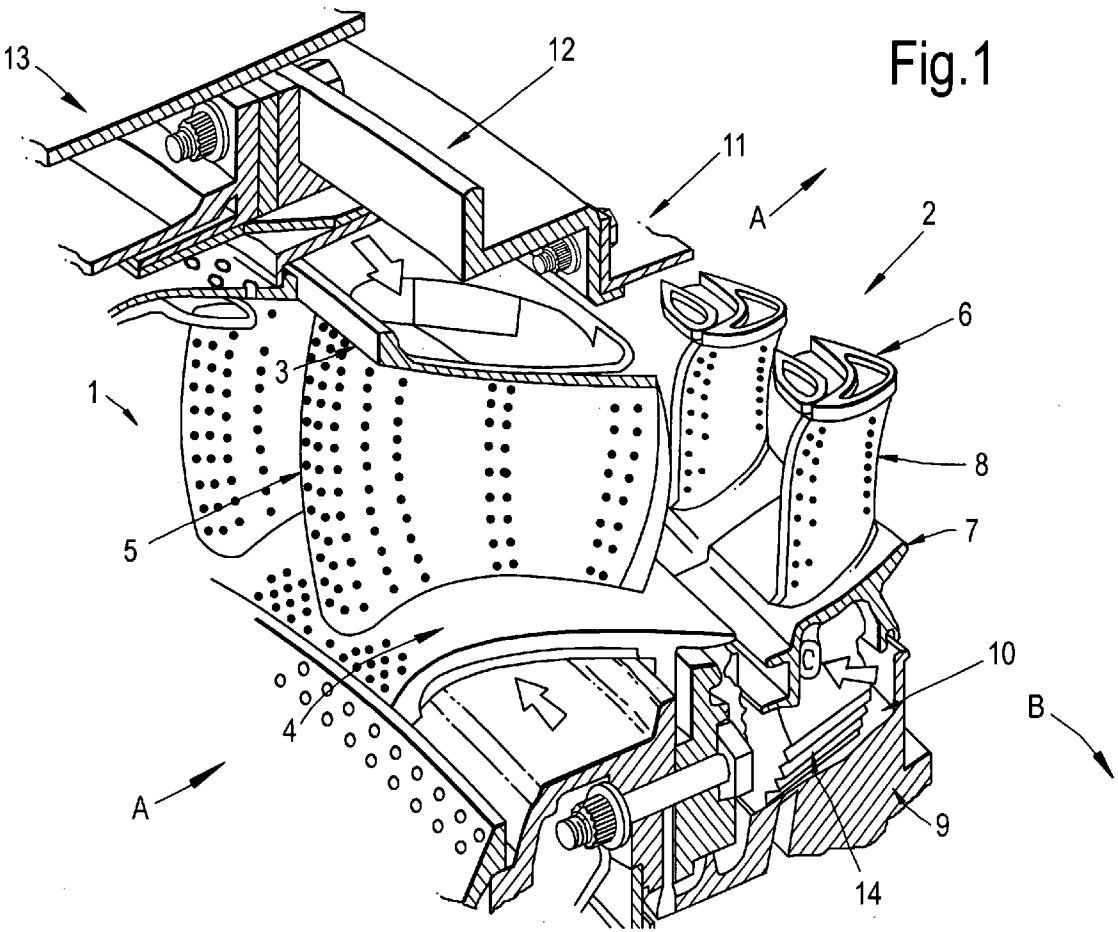
FIG. 1 is a part section of a conventional turbine of a gas turbine engine.
Figure 2:
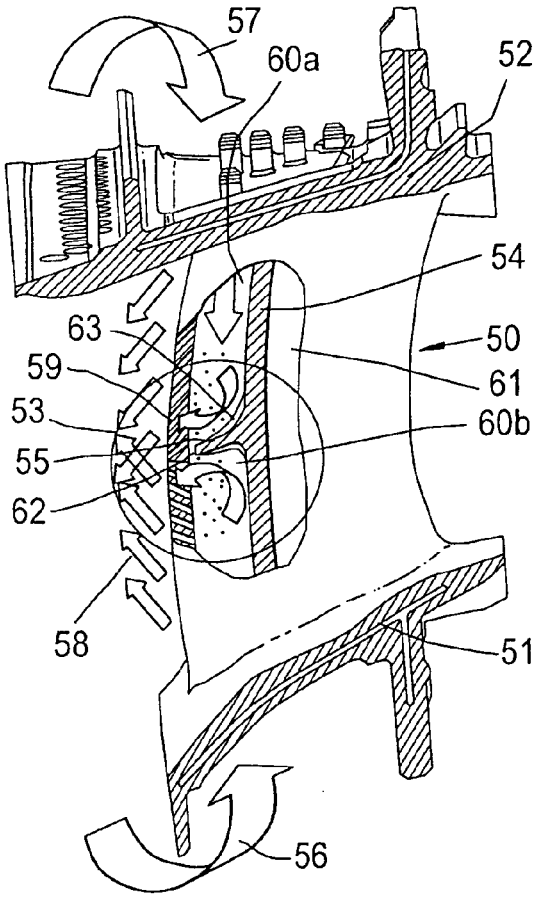
FIG. 2 is a schematic isometric view of a first embodiment of an aerofoil in accordance with aspects of the present invention.

FIG. 2 provides a cutaway side view of an aerofoil 50 in accordance with aspects of the present invention. The aerofoil 50 at opposed ends defines an inner platform 51 and an outer platform 52. A cutaway portion 53 illustrates a wall 54 in which a baffle 55 is formed. This baffle 55 is cast, or potentially cut or otherwise formed, with the wall 54. It will be appreciated that the opposed ends defined by the platforms 51, 52 provide inlets for coolant flows 56, 57. The flows 56, 57 are arranged to provide film cooling flows 58 through apertures 59 in a surface typically opposite the wall 54. As described previously if the coolant flows 56, 57 are not restrained by the baffle 55 there is a potential for direct cross jetting of the flows 56, 57 from the respective opposed inlet ends defined by the platforms 51, 52. This will result in unacceptable entry losses for the flows 56, 57 as well as a diminution in the coolant pressure particularly at intermediate portions of the aerofoil 50. It will be understood that intermediate portions will also tend to be the hottest parts of the aerofoil 50 in use.

It will be noted that the baffle 55 extends nearly across a cavity 60 defined by the spacing between the wall 54 and the generally opposed surface incorporating the apertures 59. The apertures 59 are typically angled in order to create the film cooling effect. Furthermore, the baffle 55 is orientated and positioned such that forming the apertures 59 will not compromise the baffle 55 or creation of the apertures 59.

As illustrated it will be noted that the wall 54 is generally a divider wall within the aerofoil 50. Thus as illustrated there is normally a front cavity 60 and a rear cavity 61. Baffles can be presented and projected across both cavities 60, 61 but normally consideration is particularly important with regard to the leading edge or front cavity 60. The cavities 60, 61 act as feed passages for coolant flow.

The baffle 55 extends substantially across the cavity 60 but a small cross sectional area 62 is retained to allow some fluid flow across the respective ends 60*a*, 60*b* of the cavity 60 for pressure balance.

As illustrated the baffle 55 substantially extends laterally with webs or fillets 63 to provide strength as well as reduce the potential for vibration in the baffle 55.

Figure 3:
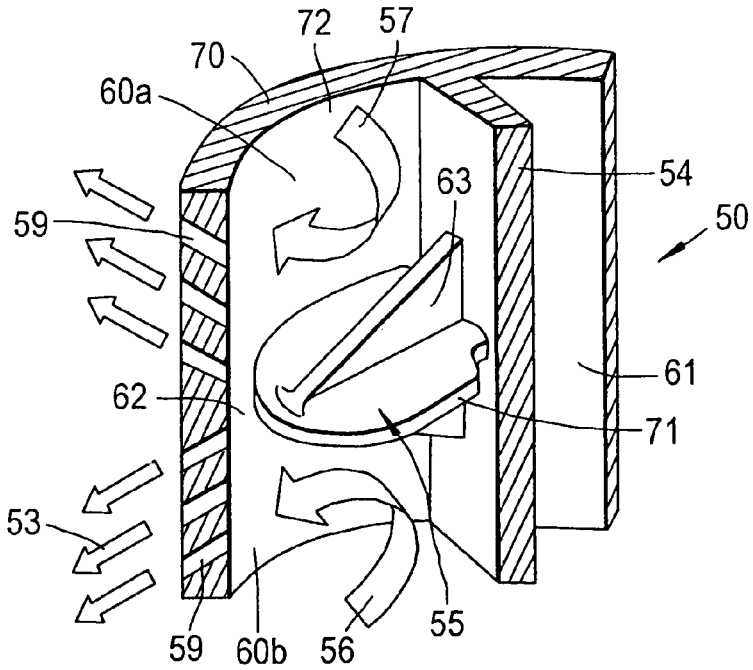
FIG. 3 is a schematic illustration of a top perspective view of the aerofoil depicted in FIG. 2.

FIG. 3 provides a more schematic isometric view of the first embodiment as depicted in FIG. 2. The baffle 55 is cast with a wall 54 which is typically a divider wall within an aerofoil 50. The divider wall 54 separates a forward cooling cavity 60 from a rear cooling cavity 61. These cavities 60, 61 define passages along which as illustrated coolant flows 56, 57 are presented from inlets (not shown). The baffle 55 is presented intermediate along the length of the cavity 60 and extends substantially across the cavity 60. It will be appreciated that the wall 54 is relatively cool compared to the external side walls 70 of the cavity 60 whether considered as pressure or suction side walls. The temperature of the baffle 55 will not be as elevated and furthermore it will be appreciated that the baffle 55 is cooled by the coolant flows 56, 57 within the cavity 60. The baffle 55 is relatively well matched to the divider wall 54 resulting in reduced local thermal gradients in the aerofoil 50.

The baffle 55 is cast with the wall 54 and provides a necessary interruption and restriction to flows 56, 57 along the aerofoil 50. As the baffle 55 is formed integrally upon casting the aerofoil 50 it will be appreciated that there is a reduction in cost in comparison with forming a separate sheet metal baffle arrangement as well as assembly of that sheet metal baffle arrangement within the aerofoil. In terms of manufacture it will be appreciated that the creation of the baffle 55 is typically achieved through alteration to a ceramic core utilised for casting of the aerofoil 50 in use.

In order to appropriately present the baffle 55 generally webs 63 are provided either side of the baffle 55. These webs 63 can comprise fillets extending laterally from the baffle 55 upon the wall 54. The webs 63 prevent the baffle 55 vibrating due to unsteady buffeting from the air flows 56, 57.

As described previously the baffle 55 will extend substantially across a gap or spacing between the wall 54 and an opposed surface incorporating the apertures 59. Generally, the gap extends about the periphery 71 with respect to a side of the opposed surface 70 incorporating the apertures 59. The cross sectional area 62 as described previously is provided as a gap to allow pressure exchange between the cavity ends 60*a*, 60*b*. Small quantities of coolant can pass from the radially outer cavity 60*a* to the radially inner cavity 60*b* and vice versa. Radially inner and outer are with respect to a main rotational axis of a gas turbine engine and when the aerofoil is installed in the engine.

The baffle 55 in terms of shape and orientation can be varied to accommodate differing aperture 59 patterns. The apertures 59 are arranged in order to achieve the desired film cooling 58 and can be different dependent upon aerofoil 50 configuration. In accordance with aspects of the present invention the baffle 55 is arranged such that the process tool utilised to form or finish pre-cast apertures 59 will not damage or be influenced by the baffle 55 integrally formed with the wall 54. A further consideration is with regard to the natural vibration or frequency of the baffle 55. In such circumstances the shape of the baffle 55 may also be determined and designed to avoid any possibility of high cycle fatigue failure due to air flows through the apertures 59 and across the gap defined by the area 62.

FIGS. 4 to 7 illustrate three different embodiments of a baffle in accordance with aspects of the present invention. These embodiments are provided for illustration purposes and it will be appreciated that other shapes, orientations and configurations of baffle are possible in accordance with aspects of the present invention.

Figure 4:
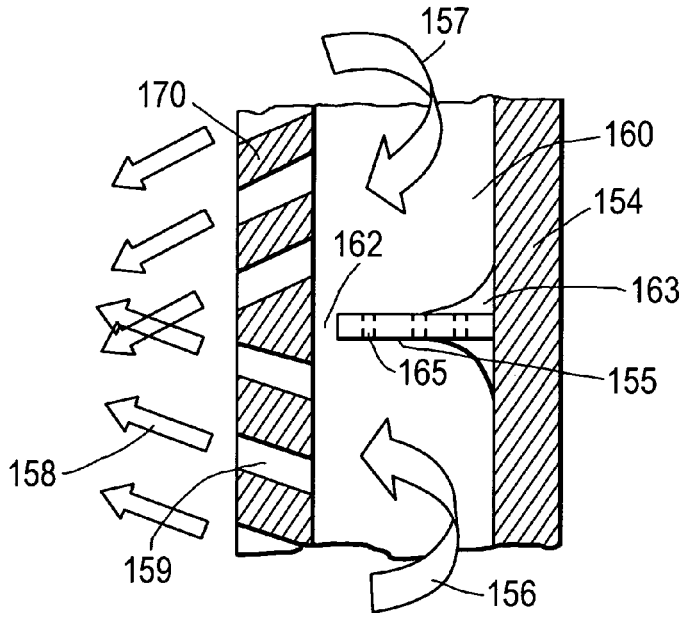
FIG. 4 is a schematic cross section of a first baffle configuration in accordance with aspects of the present invention.

FIG. 4 illustrates a first embodiment of a baffle 155 that is presented perpendicularly from a wall 154 towards a surface which is typically an external wall 170 of an aerofoil. The surface 170 opposite the wall 154 incorporates apertures 159 to direct coolant flows 156, 157 to generate film cooling 158.

The baffle 155 is configured perpendicular to a general direction of the coolant flows 156, 157. Thus the baffle 155 is substantially perpendicular to a plane of the wall 154. The apertures 159 are typically drilled at an angle to improve the film cooling effect. The angles for the apertures 159 are chosen to benefit from dynamic pressure in the passages defined by the cavities 160. Thus, the apertures 159 are generally aligned or at least turned towards the direction of coolant flow 156, 157 in the outer as well as inner cavity sections of the cavity 160.

As previously, the baffle 155 extends substantially across the cavity 160 to only leave a relatively small gap to an inner side of the surface 170 comprising the apertures 159. This gap allows a small available cross sectional area 162 for the coolant flows 156, 157 to be exchanged within the cavity 160.

A perpendicular presentation of the baffle 155 is potentially the simplest configuration for cast formation and integral association with the wall 154. However, such perpendicular presentation may also be subject to the greatest potential problems vibration and therefore stressing in use. Hence webs 163 are provided to prevent vibration as well as ensure robustness in use.

Figure 5:
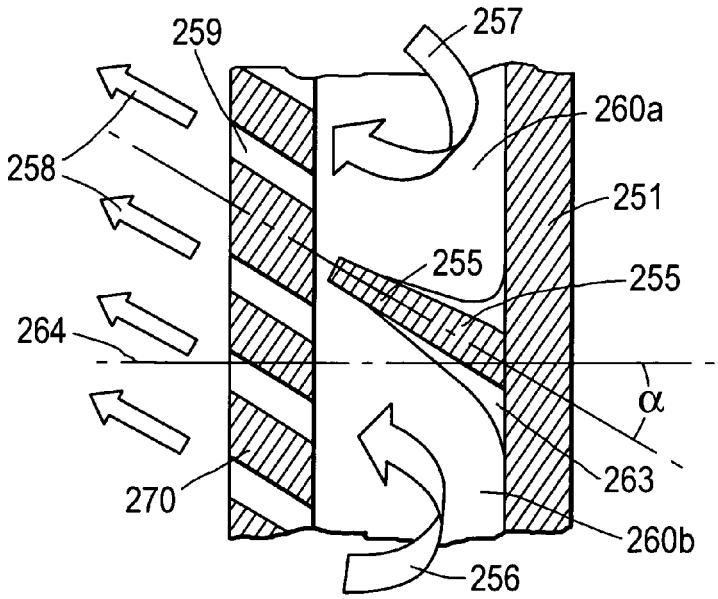
FIG. 5 is a schematic cross section of a second baffle configuration in accordance with aspects of the present invention.

FIG. 5 illustrates a second embodiment of a baffle 255 in accordance with aspects of the present invention. The baffle 255 again projects from a wall 254 towards an opposed surface 270 incorporating apertures 259. As previously coolant flows 256, 257 generally pass from inlets at opposed ends of an aerofoil. The coolant flows 256, 257 are arranged to provide film cooling 258. The baffle 255 as previously essentially divides a cavity 260 into an outer cavity section 260*a* and a inner cavity section 260*b*.

Generally the baffle 255 will be inclined at an angle between 30° and 60° to a perpendicular projection from a plane surface of the wall 254. Furthermore, the baffle 255 will be typically aligned with the apertures 259. Such alignment between the baffle 255 and the apertures 259 obviates or reduces the possibility of striking the baffle 255 when utilising a forming or process tool such as an electrode or laser beam to form the apertures 259. Nevertheless it will be appreciated that only half of the apertures 259 can benefit from a dynamic pressure head created within the cavity 260. It will be noted that the baffles 255 can be orientated upward or downward dependent upon requirements for an aerofoil. Similarly, the angle can be chosen dependent upon the angle of the apertures 259 or to achieve desired separation within the cavity 260. Again it will be noted that the baffle 255 extends substantially fully across the cavity 260 with an open cross sectional area 252 remaining available to allow coolant flow 256, 257 exchange across the respective cavity sections 260*a*, 260*b*.

Webs 263 or fillets are provided either side of the baffle 255 to provide support of and achieve greater strength in the baffle 255.

FIGS. 6, 7 and 8 provide illustrations respectively of a side and front schematic view of a third embodiment of a baffle 355 in accordance with the present invention. The baffle 355 extends within a cavity 360 to define an outer cavity section 360*a* and an inner cavity section 360*b*. The baffle 355 extends towards a surface 370 which is typically an external wall surface of an aerofoil. The surface 370 incorporates apertures 359 which receive coolant flows 356, 357 in order to define film cooling 358. As previously the baffle 355 divides the cavity 360 in order to prevent direct jetting of the coolant flows 356, 357 across the passage defined by the cavity 360. Generally a gap is provided around the baffle 355 to allow coolant flow exchange between the cavity section 360*a*, 360*b*.

The baffle 355 in accordance with the third embodiment is generally angled to be inclined from a first side 380 to a second side 381. Such a configuration allows further coolant flow control to the apertures 359 for coolant film 358 creation. The baffle 355 is orientated at an angle when viewed in the direction of a wall 354 that is to say as viewed in the direction A-A. Such a configuration provides benefits including enabling construction of an aerofoil configuration with cooling film apertures in rows where the gap between apertures in the same row, to accommodate the baffle 355, are not in alignment with a hot gas flow over the surface 370.

Typically, the baffle 355 will be configured to have an orientation at a compound angle which is a combination of the upward or downward orientation as depicted in FIG. 5 together with an inclined angle or presentation as depicted in FIG. 7 from the first side 380 to the second side 381 of the cavity 360.

The aerofoil comprises a radial axis 391, when installed in an engine, with the cavity generally radially aligned at an inlet 392, 393 for fluid flow in use at each end of a radially inner and a radially outer end of the aerofoil. The baffle 55, 155, 255, 355 comprises an angled portion 394, which has an angle θ between 15 and 75 degrees from the radial axis although the preferable range of angle is between 30 and 60 degrees. The angled portion is part of the baffle which is straight.

One important advantage of the angled baffle is that the aerofoil is then provided with coolant apertures 359, through the wall 380, which are generally arranged in a line parallel to the angled portion of the baffle. With a sufficiently angled baffle the line of apertures means that a coolant flow issuing from the line of apertures creates a continuous film of coolant over the surface of the wall and aerofoil. This advantageously prevents the hot working gasses creating hot streaks on and high thermal gradients in the wall thereby extending the life of the aerofoil.

Even where the baffle is not straight this advantage can be achieved as shown in FIGS. 9 *a, b, c* where the angled portion is part of the baffle which are generally V-, U- or W-shaped. The coolant apertures 359 can be spaced such that they form an even distribution of coolant 359*f* over the surface of the wall 380.

Referring back to FIG. 5, the aerofoil has a second axis 264 that is perpendicular to the radial axis and would be generally aligned to a main rotational axis of a gas turbine engine. The baffle 255 again comprises at least a portion that is angled α between 15 and 75 degrees from the second axis. It is more likely that the baffle is angled between 30 and 60 degrees.

The coolant apertures 359 are normally laser drilled and therefore angling the coolant apertures for both the first and second angles, so that they are approximately parallel to the baffle's main surfaces means that a regular and sufficient array of coolant apertures can be drilled without destroying the baffle. The angles of the baffle and apertures are designed for each specific aerofoil and the engine's particular gas flow regime. The present invention is believed to be adequate to allow the coolant apertures to be angled accordingly and give further flexibility in their outlet position in order to evenly distribute coolant flow and prevent hot streaks.

It will be appreciated that integral formation of a baffle reduces costs and therefore expense of manufacture and part count which will aid logistically as well as administratively simpler provision of spare parts in use. Furthermore as the cast and integrally formed baffle cannot shake loose in operation there is greater reliability of operation. Furthermore the position of the baffle can be reliably and repeatedly achieved ensuring that where machine tools are utilised to define the film cooling apertures these machining tools, such as lasers or drills, will not strike of the baffle causing damage, deflection or loss.

As there is integral construction, a rigid structure can be provided which has less vibration problems and furthermore as there are no separate parts with respect to the baffle problems such as fretting and wear can be avoided. By integral forming within the aerofoil the potential for mistaken build without incorporation of the baffle plate is avoided. Additionally, problems with regard to incorrect fitting can be avoided by integral casting of the baffle within the cavity. By eliminating the necessity for locating lugs within a cavity the core tools utilised for forming the cavity in accordance with aspects of the present invention may be simplified.

By creating the baffle integrally within the cavity the potential for damage is avoided. It will be appreciated that plate baffles extending outwardly are generally relatively fragile and subject to damage.

The baffles in accordance with aspects of the present invention are designed and configured to accommodate differing leading and trailing edge cooling regimes in the respective cavities. As the baffle is formed from the same material as the aerofoil and as the baffle is bathed in coolant air problems of oxidation are avoided. The baffle and other internal surfaces of the cavity may be protected by an appropriate coating from sulphidation.

Alternative is to provide specific shaping of the baffle, for example a curved baffle, may be provided. This may take the form of a half cylindrical cross section angled upwards or downwards as described with regard to FIG. 5. A further alternative is to provide a curved baffle in a scoop shape extending from the surface in order to create desired separation of a cavity within which coolant flows are presented. It will be appreciated that curved baffles will still typically incorporate webs to provide reinforcement and avoid vibration.

Internal walls within an aerofoil and in particular divider walls between a front and rear cavity are particularly advantageous for presenting baffles. However alternatively other internal walls of a cavity may be utilised to present the baffle plates as required.

An alternative to the small gap between the baffle and the opposed surface is to provide the baffle plate with perforations. These perforations will take the place of one or more holes which again will allow a small proportion of coolant flow exchange across the baffle but still substantially prevent direct jetting from inlets at opposite ends of the cavity.

Embodiments of the present invention described above illustrate a single substantial baffle extending across the cavity. However, in some situations a plurality of baffles may be provided. A principal baffle may be utilised along with a series of partial baffles which extend from the wall. These baffles may alter the gap and therefore the available cross sectional area in the spacing between the baffle 255 and the opposed surface incorporating the apertures 259. Such variations in the available cross sectional area allows control of coolant flow and potentially accelerates the coolant flow in the passage progressively as flow is bled off through the apertures from the cavity. Such acceleration in flow increases the Reynolds number of the flow and therefore the heat transfer rate within the cavity.

A baffle might be considered as any cast feature that effectively blocks or partially blocks the passage of coolant flow within the cavity and prevents that coolant flow from passing from the inlet at one end of the cavity directly to the inlet at the other end of the cavity.

Modifications and alterations to aspects of the present invention will be appreciated by those skilled in the art. Thus sides of the baffle may be dished dependent upon requirements. An edge of the baffle may be fluted or castellated such that effectively segments are provided with gaps between rather than a continuous gap about the edge of the baffle towards an opposed surface incorporating the apertures to define film cooling.

Partial baffles may be provided extending proportionately from a wall or walls such that the combination of baffles within the cavity prevents a direct flow path and therefore direct jetting across the cavity in use. Such an approach may allow easier cast formation in creating integral baffles.

The invention claimed is:

1. An aerofoil comprising:

a radial axis and a hollow core to define a cavity, the core having a divider wall;

an inlet for fluid flow in use at each end of a radially inner and a radially outer end of the aerofoil, wherein a baffle is integrally formed with the divider wall to extend across the cavity to present a flow restraint between the inlets; and the baffle comprises an angled portion that is angled from a suction side of the airfoil to a pressure side of the airfoil at an angle $\theta$, and the angle $\theta$ is between 15 and 75 degrees from the radial axis.

2. The aerofoil as claimed in claim 1, wherein the angle $\theta$ is between 30 and 60 degrees from the radial axis.

3. The aerofoil as claimed in claim 1, wherein the angled portion is part of the baffle which is generally straight, U-, V- or W-shaped.

4. The aerofoil as claimed in claim 1, wherein coolant apertures are provided in a surface opposite the divider wall and are generally arranged in a line parallel to the angled portion of the baffle.

5. The aerofoil as claimed in claim 1, wherein the aerofoil has a second axis, perpendicular to the radial axis, and the baffle comprises a portion angled from a perpendicular projection from a plane surface of the divider wall at an angle $\alpha$ to the second axis.

6. The aerofoil as claimed in claim 5, wherein the angle $\alpha$ is between 15 and 75 degrees from the second axis.

7. The aerofoil as claimed in claim 5, wherein the angle $\alpha$ is between 30 and 60 degrees from the second axis.

8. The aerofoil as claimed in claim 5, wherein coolant apertures are provided in the divider wall and at least one of the apertures is angled at the angle $\alpha$ approximately parallel to the baffle.

9. The aerofoil as claimed in claim 5, wherein the baffle is orientated towards alignment with the apertures.

10. The aerofoil as claimed in claim 1, wherein the baffle extends nearly fully across the cavity to define a predetermined available cross sectional area for fluid flow exchange either side of the baffle.

11. The aerofoil as claimed in claim 1, wherein the cavity incorporates a plurality of baffles.

12. The aerofoil as claimed in claim 1, wherein the baffle has a web that:

a) extends from a center portion of the baffle, b) extends outward from the baffle in a substantially radial direction of the aerofoil, and c) is configured to stiffen association of the baffle with the wall.

13. The aerofoil as claimed in claim 1, wherein the baffle is perforated with holes.

* * * * *